US010577783B2

(12) United States Patent
Farcet et al.

(10) Patent No.: US 10,577,783 B2
(45) Date of Patent: Mar. 3, 2020

(54) ELEMENT FOR DISPENSING A MIXTURE OF WATER AND COSMETIC PRODUCT, ASSOCIATED DEVICE AND METHOD

(71) Applicant: L'OREAL, Paris (FR)

(72) Inventors: Céline Farcet, Annet/Marne (FR); Laurent Gilbert, Fourqueux (FR); Ronan Delisle, Auriol (FR)

(73) Assignee: L'OREAL, Paris (FR)

( * ) Notice: Subject to any disclaimer, the term of this patent is extended or adjusted under 35 U.S.C. 154(b) by 34 days.

(21) Appl. No.: 15/307,436

(22) PCT Filed: Apr. 29, 2015

(86) PCT No.: PCT/EP2015/059293
§ 371 (c)(1),
(2) Date: Oct. 28, 2016

(87) PCT Pub. No.: WO2015/165938
PCT Pub. Date: Nov. 5, 2015

(65) Prior Publication Data

US 2017/0051480 A1 Feb. 23, 2017

(30) Foreign Application Priority Data

Apr. 29, 2014 (FR) ..... 14 53871

(51) Int. Cl.

| | |
|---|---|
| ***E03C 1/046*** | (2006.01) |
| ***B05B 1/18*** | (2006.01) |
| ***B05B 7/00*** | (2006.01) |
| ***B05B 7/24*** | (2006.01) |
| ***B01F 15/02*** | (2006.01) |

(Continued)

(52) U.S. Cl.
CPC ..... *E03C 1/046* (2013.01); *B01F 1/0027* (2013.01); *B01F 15/0206* (2013.01); *B01F 15/0207* (2013.01); *B05B 1/18* (2013.01); *B05B 7/0093* (2013.01); *B05B 7/0408* (2013.01); *B05B 7/08* (2013.01); *B05B 7/2443* (2013.01);

(Continued)

(58) Field of Classification Search
CPC ..... B05B 1/18; B05B 7/0093; B05B 7/0408; B05B 7/08; B05B 7/2443; B05B 7/2462; B05B 1/16; B05B 7/0018; E03C 1/046; B01F 15/0206; B01F 15/0207; B01F 1/0027; B01F 2215/0031
See application file for complete search history.

(56) References Cited

U.S. PATENT DOCUMENTS 2,602,699 A * 7/1952 Otto ..... E03C 1/046 137/268
4,211,368 A 7/1980 Legros et al.

(Continued)

*Primary Examiner* — Arthur O. Hall
*Assistant Examiner* — Steven M Cernoch
(74) *Attorney, Agent, or Firm* — Polsinelli PC

(57) ABSTRACT

The element comprises:
- a hollow body;
- a receptacle (40) for receiving a cosmetic product, housed in the hollow body;
- a conduit (42) for supplying water into the receptacle (40);
- a nozzle (50) for dispensing the mixture of water and cosmetic product from the dispensing element.

The element comprises an inner water dispensing nozzle (44), connected to the water supply conduit (42), the inner nozzle (44) protruding into the receptacle (40) to define a chamber (46) for mixing water and the cosmetic product contained in the receptacle (40).

20 Claims, 2 Drawing Sheets

(51) Int. Cl.

| | |
|---|---|
| ***B01F 1/00*** | (2006.01) |
| ***B05B 7/04*** | (2006.01) |
| ***B05B 7/08*** | (2006.01) |
| *B05B 1/16* | (2006.01) |

(52) U.S. Cl.
CPC .... *B05B 7/2462* (2013.01); *B01F 2215/0031* (2013.01); *B05B 1/16* (2013.01); *B05B 7/0018* (2013.01)

(56) References Cited

U.S. PATENT DOCUMENTS 4,840,311 A * 6/1989 Shamblin ..... B05B 7/2454 239/305
5,772,119 A * 6/1998 Someya ..... C02F 1/003 239/315
5,826,492 A 10/1998 Fond et al.
5,957,379 A 9/1999 McMorrow et al.
6,000,626 A * 12/1999 Futo ..... A46B 11/066 239/333
6,006,374 A * 12/1999 Winnett ..... B05B 7/2462 239/312
6,279,836 B1 * 8/2001 Toetschinger ..... B05B 7/2443 239/70
6,814,306 B1 * 11/2004 Okubo ..... B05B 3/04 137/268
6,885,114 B2 * 4/2005 Baarman ..... C02F 1/325 290/43
8,820,660 B2 * 9/2014 Ajagbe ..... B05B 1/18 239/315
2008/0272200 A1 * 11/2008 Ordiway ..... E03D 9/032 239/7
2009/0250532 A1 * 10/2009 Ganan Calvo ..... B05B 7/1686 239/137
2010/0051719 A1 3/2010 Carlucci et al.

* cited by examiner

ELEMENT FOR DISPENSING A MIXTURE OF WATER AND COSMETIC PRODUCT, ASSOCIATED DEVICE AND METHOD

CROSS REFERENCE TO RELATED APPLICATIONS

This application is a National Phase filing under 35 U.S.C. § 371 of PCT/EP2015/059293 filed on Apr. 29, 2015; and this application claims priority to Application No. 1453871 filed in France on Apr. 29, 2014 under 35 U.S.C. § 119. The entire contents of each application are hereby incorporated by reference.

The present invention relates to an element for dispensing a mixture of water and cosmetic product.

Such an element is for example a shower head intended to be mounted at the free end of a device for spraying fluid for washing and/or treating a body surface.

To perform this wash/treatment, the spraying device sprays in a first phase a mixture of water and cosmetic product, and in a second phase rinsing water.

This device is used particularly for washing/treating a user's keratin fibers, such as hair, or for washing/treating a user's skin.

The cosmetic product is advantageously a washing formula, such as a soap, shower gel, powder and/or shampoo. Alternatively, the cosmetic product contains or consists of a care product, particularly for the hands, face, body, hair. In a further alternative, the cosmetic product is in the form of a capsule or free product, or more generally in solid, paste or liquid galenic form.

"Cosmetic product" means in particular, in the sense of this invention, a product such as defined in EC Regulation no. 1223/2009 of the European Parliament and of the Council of Nov. 30, 2009 relating to cosmetic products.

Water consumption associated with operations for washing/treating a user's hair or skin is generally very high, for example in the region of tens of liters for a shampoo. Such consumption is thus only compatible with access to running water allowing a high water supply capacity and a corresponding waste water treatment capacity. An adequate spraying capacity is also required so as not pour out all the rinsing water in one go.

However, such access to running water is sometimes rendered difficult or impossible, on a sporadic or ongoing basis, according to the region in which the user is located.

The user generally seeks to be able to continue to have high capacities for washing and/or treating the user's skin and hair, regardless of the region in which the user is located, and without compromising the cosmetic qualities of the treatment.

Furthermore, for environmental reasons, it is desirable to reduce the quantity of clean water used, and the quantity of waste water produced during operations for washing and/or treating a user's skin or hair.

KR20110001290 and KR20100010882 describe a microbubble system associated with a shower head, so as to reduce the quantity of washing product by 15% to 30%. Such a system reduces skin irritations, reduces the quantity of water required for treatment and facilitates waste water treatment.

Such a shower head does not however allow adequate lathering, without involving a large quantity of water.

FR2906485, DE19908121, DE2951318 and WO2008/155792 describe shower heads suitable for mixing water and cosmetic products. However, these shower heads are not suitable for reducing water consumption.

One aim of the invention is that of obtaining a dispensing element which reduces water consumption very significantly, while offering the user similar or equivalent sensations to that of a conventional wash or treatment.

For this purpose, the invention relates to an element of the type mentioned above, comprising:

a hollow body;

a receptacle for receiving a cosmetic product, housed in the hollow body (19);

a conduit for supplying water into the receptacle;

the hollow body defining a downstream chamber connected to the receptacle for receiving a mixture of water and cosmetic product from the receptacle, the dispensing element comprising:

at least one nozzle for dispensing the mixture of water and cosmetic product from the dispensing element;

the element comprising an inner water dispensing nozzle, connected to the water supply conduit, the inner nozzle protruding into the receptacle to define a chamber for mixing water and the cosmetic product contained in the receptacle.

The element according to the invention may include one or more of the following features, taken alone or in any technically possible combination:

- the inner nozzle is suitable for generating a hollow cone type spray in the mixing chamber.
- the inner nozzle is suitable for generating drops having an average size of less than 3 mm, in particular comprised between 0.5 mm and 2 mm.
- the inner nozzle extends along an inner nozzle axis into the mixing chamber, facing and axially shifted from a bottom wall of the receptacle, the length of the inner nozzle inserted into the mixing chamber along the inner nozzle axis being advantageously comprised between 25% and 50% of the length of the mixing chamber, measured along the inner nozzle axis between a wall for accessing the mixing chamber, through which the inner nozzle is inserted, and the bottom wall.
- the receptacle has an outlet for discharging the mixture of water and cosmetic product to the downstream chamber flowing in the direction opposite the direction for spraying water from the inner nozzle.
- the discharge outlet extends around the inner nozzle.
- the downstream chamber comprises an upstream region for receiving the mixture of water and cosmetic product and a downstream region for discharging the mixture of water and cosmetic product flowing into the dispensing nozzle, the upstream region and the downstream region being situated on either side of the receptacle.
- the downstream chamber comprises an upstream region for receiving the mixture of water and cosmetic product and a downstream region for discharging the water mixture, the element comprising a perforated member for treating the mixture of water and cosmetic product separating the upstream region from the downstream region.
- the receptacle is formed by a removable capsule relative to the hollow body, the element advantageously comprising a base for locking the removable receptacle in the hollow body.
- the receptacle is permanently mounted in the hollow body.
- the hollow body forms a shower head advantageously intended to be connected to a running water network.
- it comprises a nozzle for delivering a separate rinsing fluid from the dispensing nozzle.

The invention also relates to a device for spraying fluid, comprising:

a water container or a running water network;

an element as defined above; and an assembly for conveying water from the water container or to the running water network to the element, the container, the element and the conveying assembly being advantageously jointly movable on a platform.

The device according to the invention may include one or more of the following features, taken alone or in any technically possible combination:

the maximum volume of clean water to be contained in the water container is less than 50 liters.

The invention also relates to a method for dispensing a mixture of water and cosmetic product applicator, including the following steps:

supply of a device such as that defined above;

supplying water from the container via the conveying assembly to the water supply conduit;

injecting water into the mixing chamber via the inner nozzle;

mixing the water and cosmetic product in the mixing chamber;

dispensing the mixture of water and cosmetic product via the dispensing nozzle.

The method according to the invention can include one or more of the following features, considered alone or in any technically possible combination:

it comprises a prior step for loading a receptacle containing cosmetic product into the hollow body or a prior step for filling the receptacle in the hollow body with a cosmetic product.

The invention will be easier to understand in view of the following description, provided solely as an example, and with reference to the appended drawings, wherein.

Hereinafter, the terms "upstream" and "downstream" refer to the normal direction of flow of a fluid, particularly from inside to outside the device and from the dispensing element.

Figure 1:
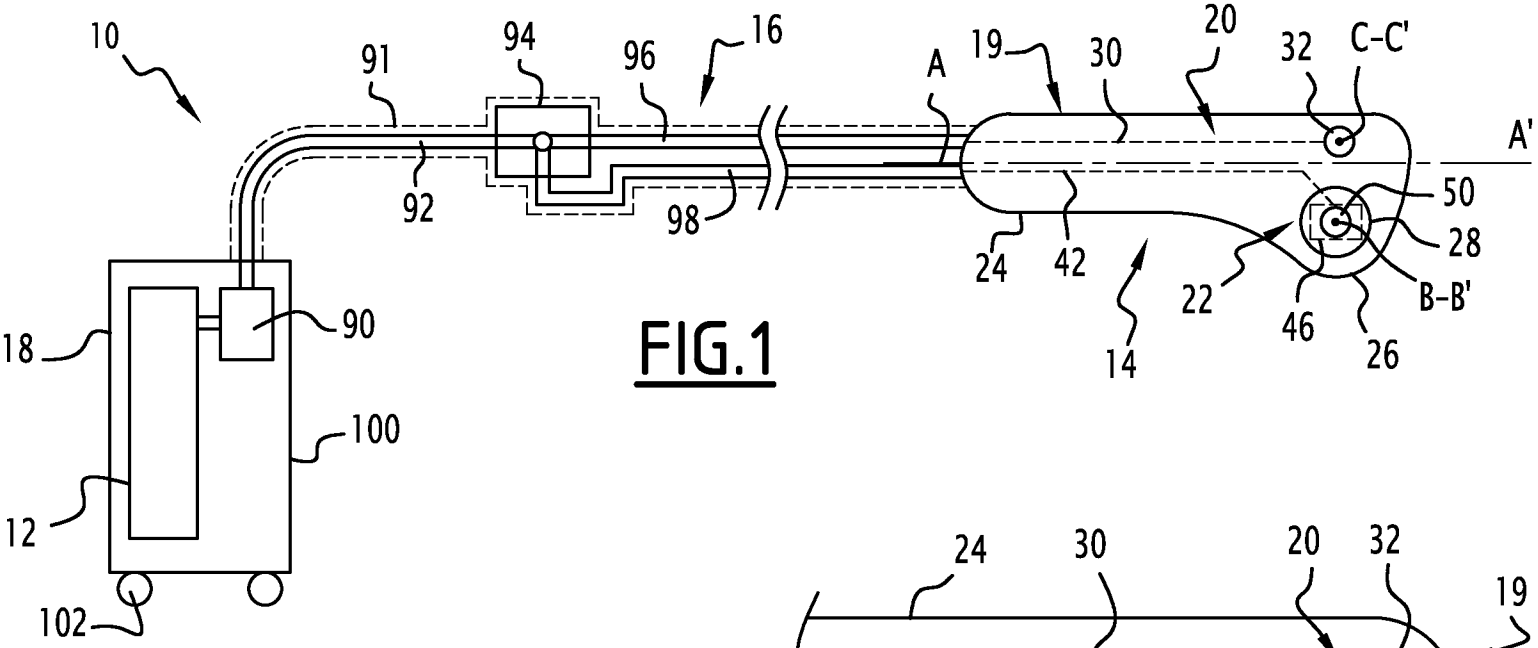
FIG. 1 is a schematic view of a first device for spraying fluid comprising a dispensing element according to the invention formed by a shower head.

A first device 10 for spraying fluid according to the invention is shown in FIG. 1.

This device 10 is intended to selectively dispense either a mixture of water and cosmetic product, for washing and/or treating a body surface of a user, or water for rinsing the body surface.

The cosmetic product is for example a washing product, a treatment product and/or a care product, particularly for the hands, face, body, hair.

It is presented for example in solid or very concentrated form with a low water content, in the form of gel, powder, particularly effervescent, paste, sachet, capsule, tablet, solidified foam, sheets, liquid concentrated with active substances and/or in any galenic form.

With reference to FIG. 1, the device 10 comprises a water container 12, a dispensing element according to the invention, represented herein by a shower head 14, and an assembly 16 for conveying water connecting the water container 12 to the shower head 14.

In this example, the device 10 is suitable for being moved integrally manually by a user. It comprises a platform 18 for moving the water container 12, the conveying assembly 16, and the shower head 14 together.

The container 12 has a maximum water receiving volume of less than 50 liters and particularly between 7 liters and 40 liters, or between 2 liters and 45 liters, particularly between 10 liters and 35 liters, for example between 15 liters and 25 liters. It contains rinsing water.

According to the invention, the head 14 is suitable for selectively dispensing either water for rinsing the user, or a mixture of water and cosmetic product for washing and/or treating a body surface of a user consisting of skin and/or keratin fibers.

The head 14 comprises a hollow body 19, a module 20 for delivering rinsing water and a parallel module 22 for dispensing water and cosmetic product, the modules 20, 22 being borne by the hollow body 19.

As illustrated in FIGS. 1 to 3, 5, and 6, the hollow body 19 comprises herein a handle 24, advantageously intended to be gripped by the user's hand, a support head 26 and a cap 28 removably mounted on the support head 26.

In this example, the handle 24 extends longitudinally along an axis A-A'.

The support head 26 is hollow. It protrudes herein transversally relative to the handle 24. Further arrangements could be envisaged according to the chosen ergonomics.

The cap 28 is removably mounted on the support head 26 between a position for accessing the mixing module 22 and a closing position. It is advantageously suitable for screwing or engaging on the support head 26 by means of a combined movement translating toward the support head 26 and rotating about a central transverse axis B-B' relative to the longitudinal axis A-A'.

Figure 2:
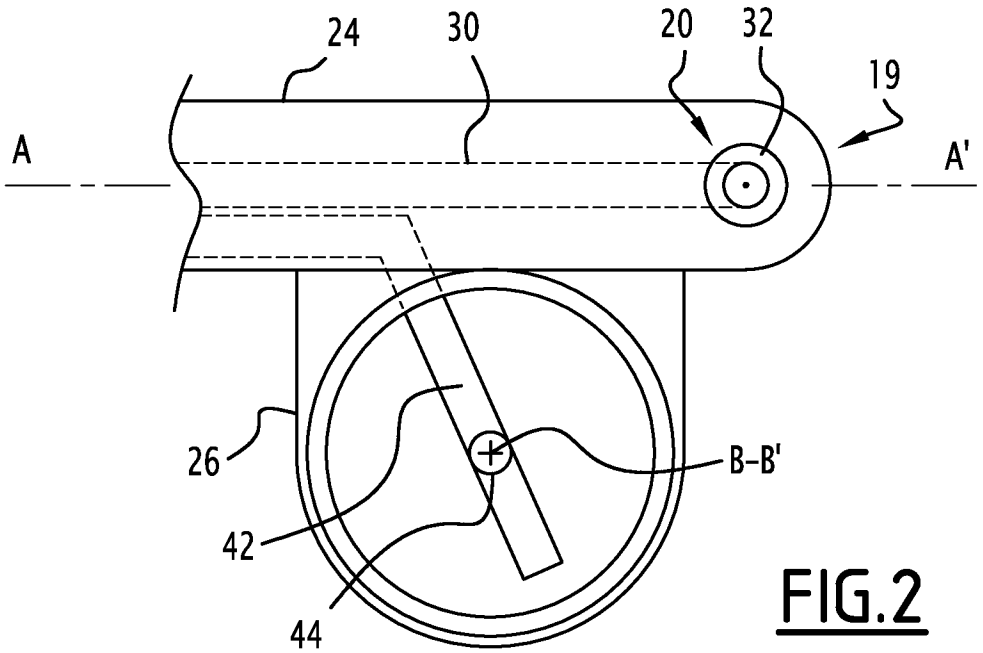
FIG. 2 is a partial bottom view of an end region of the shower head in FIG. 1, with the cap in FIG. 3 having been removed.
Figure 3:
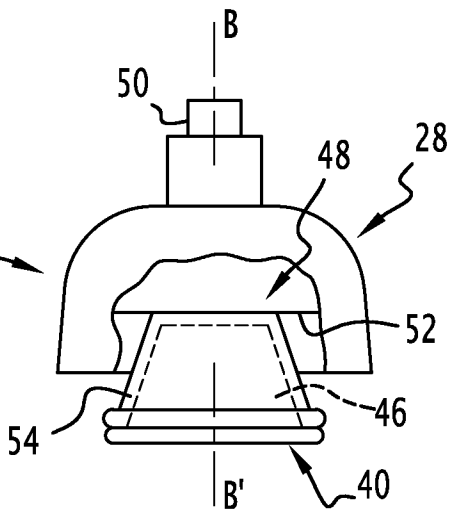
FIG. 3 is a partially sectional side view of a cap to be mounted on the end region of the shower head in FIG. 1.
Figure 7:
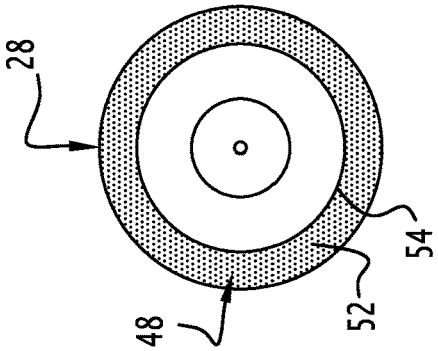
FIG. 7 is an end view of the interior of the cap in FIG. 6.
Figure 9:
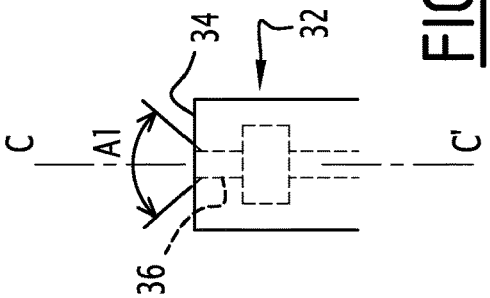
FIG. 9 is a side view of a nozzle for delivering rinsing water, mounted on the shower head in FIG. 1.

With reference to FIGS. 1, 2 and 9, the delivery module 20 comprises a conduit 30 for supplying rinsing water, and a nozzle 32 for delivering rinsing water, advantageously suitable for producing drops of substantial size.

The supply conduit 30 extends herein through the handle 24. It opens transversally into the delivery nozzle 32.

The delivery nozzle 32 is suitable for producing droplets greater than 1 mm in diameter, and particularly between 1 mm and 5 mm, particularly between 1 mm and 3 mm, advantageously between 1 mm and 2 mm.

The delivery nozzle 32 receives a water flow from the supply conduit 30. The nozzle is suitable for accommodating a flow rate of less than 3 liters per minute, particularly less than 2 liters per minute.

The water flow accommodated by the delivery nozzle 32 then has a pressure advantageously less than 5 bar, particularly between 2 bar and 4 bar, particularly equal to 3 bar.

Preferably, the delivery nozzle 32 is a solid cone male nozzle. With reference to FIG. 9, it has a solid transverse free surface 34. The surface 34 is perpendicular to the axis C-C' for delivering the liquid via the orifice 36 thereof.

The delivery nozzle 32 advantageously has an internal screw upstream from the orifice 36. It is for example made of metal.

With reference to FIG. 9, the outlet angle A1 of the flow of droplets generated by the delivery nozzle 32 is less than 100°, and is particularly between 80° and 60°.

An example of delivery nozzle 32 is marketed by SODERCO under the reference XL-FN 00 2.4-70.

The droplets generated by the set of nozzles enable effective wetting and rinsing of the keratin fibers and/or skin, with a rinsing time in the region of one minute, and a water consumption of less than 2 l, advantageously for 6 g of shampoo and medium-length hair (base of neck).

With reference to FIGS. 1 to 8, the dispensing module 22 comprises a receptacle 40 for receiving cosmetic product and a conduit 42 for supplying water into the receptacle 40.

Figure 4:
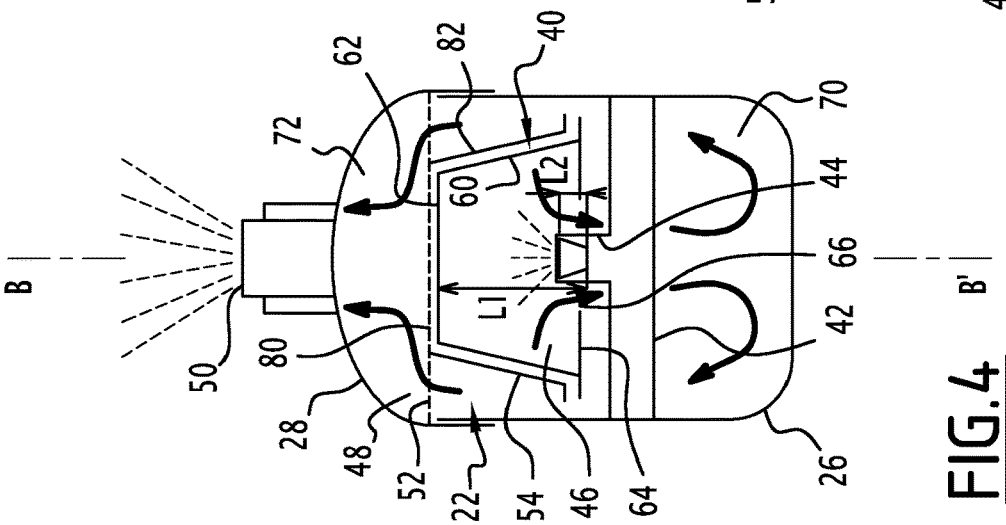
FIG. 4 is a schematic sectional view along a median axial plane of the end region of the shower head, when mixing water and the cosmetic product.

According to the invention, the dispensing module 22 comprises an inner nozzle 44 for injecting water, protruding into the receptacle 40 from the supply conduit 42, to define a mixing chamber 46 between the water supplied by the supply conduit 42 and the cosmetic product contained in the receptacle 40, seen in FIG. 4.

The dispensing module 22 further defines a downstream chamber 48 connected to the receptacle 40 for receiving the mixture of water and cosmetic product. It comprises a nozzle 50 for dispensing the mixture, flowing upstream into the downstream chamber 48, and downstream from the shower head 14.

The dispensing module 22 further advantageously comprises a perforated member 52, inserted in the downstream chamber 48 and, in the example shown in FIGS. 1 to 8, a base 54 for supporting the receptacle 40.

The receptacle 40 contains a cosmetic product, as defined above.

In the example represented in FIGS. 1 to 8, the receptacle 40 is inserted removably into the hollow body 19. It is suitable for being replaced by a further receptacle 40, when the cosmetic product contained in the receptacle 40 has been used up, or when the user wishes to change cosmetic product.

In this example, the receptacle 40 consists of a capsule. The capsule is disposable, being suitable for recycling and/or dissolution.

Alternatively, as seen hereinafter, the receptacle 40 is secured in the hollow body 19. It is then formed for example directly by the base 54.

The receptacle 40 is positioned in the downstream chamber 48, being advantageously oriented along the central axis B-B'. It is herein borne by the cap 28.

Figure 5:
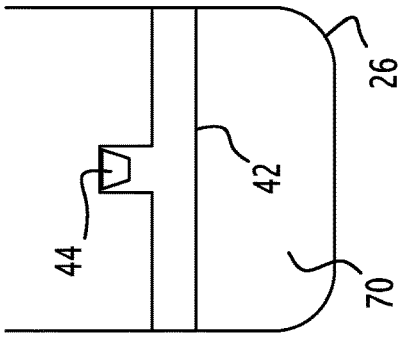
FIG. 5 is a schematic sectional view of the end region, with the cap having been removed.
Figure 6:
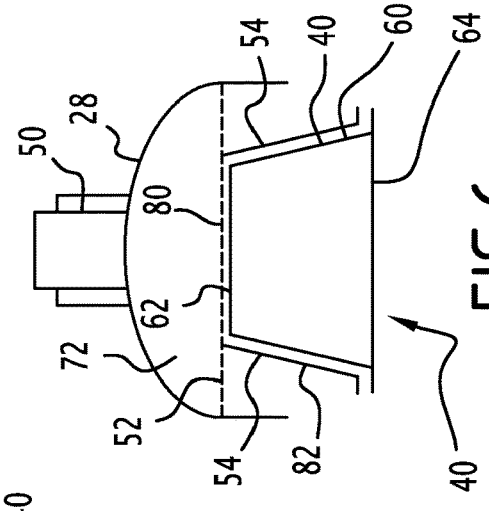
FIG. 6 is a similar view to FIG. 5 illustrating the cap.

With reference to FIGS. 4 to 6, the receptacle 40 comprises a side wall 60, for example of tapered shape, a bottom wall 62 and a wall 64 for accessing the container, the walls 62, 64 extending on either side of the side wall 60.

Advantageously, the bottom wall 62 and the side wall 60 form a single piece. They are for example made of a thermoplastic material.

The access wall 64 is mounted on the side wall 60. It is for example formed from a material suitable for tearing or perforation, such as metal or plastic sheet.

It is suitable for being perforated by the nozzle 44.

The receptacle 40 is suitable for being inserted into the base 54. In this configuration, the bottom wall 62 is aligned on the central part of the perforated member 52. It is situated relatively closer to the dispensing nozzle 50.

The access wall 64 is arranged relatively closer to the supply conduit 42. It is perforated by the inner nozzle 44.

The walls 60 to 64 externally define the mixing chamber 46 when the inner nozzle 44 is inserted into the receptacle 40.

The supply conduit 42 protrudes into the downstream chamber 48, facing the receptacle 40, preferably transversally relative to the central axis B-B'.

The inner nozzle 44 protrudes laterally from the supply conduit 42. It extends at least partially into the receptacle 40 having passed through the access wall 64. It is preferably perpendicular to the access wall 64.

The inner nozzle 44 extends along an inner nozzle axis, herein coaxial with the axis B-B', in the mixing chamber 46. It extends facing and axially shifted from the bottom wall 62 of the receptacle. The length L2 of the nozzle 44 inserted in the mixing chamber 46 along the axis B-B' is advantageously between 20% and 50% of the length L1 of the mixing chamber 46, measured along the axis B-B' between the access wall 64 and the bottom wall 62.

The inner nozzle 44 flows axially along the axis B-B' toward the dispensing nozzle 50, opposite the supply conduit 42.

The inner nozzle 44 defines with the receptacle 40, a downstream outlet 66 for discharging the mixture of water and cosmetic product, which flows into the downstream chamber 48.

In this example, the downstream outlet 66 is defined internally by the inner nozzle 44, about said nozzle. It is defined externally by the access wall 64, in the region perforated by the inner nozzle 44.

The downstream outlet 66 connects the mixing chamber 46 to the downstream chamber 48. It flows toward the supply conduit 42, in the opposite direction of the spraying direction of the inner nozzle 44 and the dispensing nozzle 50.

The inner nozzle 44 is suitable for producing droplets less than 3 mm in diameter, and particularly less than 1 mm, particularly comprised between 0.5 mm and 3 mm.

The outlet angle of the flow of droplets generated by the delivery nozzle 44 is less than 100°, and is particularly between 80° and 60°.

The downstream chamber 48 is defined between the head 26 and the cap 28. It comprises an upstream region 70 defined by the head 26 and a downstream region 72 defined by the cap 28.

The upstream region 70 is arranged opposite the downstream region 72 relative to the receptacle 40. It contains the supply conduit 42.

The downstream outlet 66 opens into the upstream region 70, toward the bottom in FIG. 4.

The downstream region 72 flows into the dispensing nozzle 50.

The dispensing nozzle 50 protrudes above the cap 28. It is suitable for producing droplets having a diameter less than 1 mm, preferably less than 0.5 mm and particularly comprised between 1 μm and 1000 μm.

It is suitable for accommodating a flow of mixture of water and cosmetic product at a flow rate less than 1 liter per minute, particularly less than 0.9 liter per minute from the downstream region 72 of the downstream chamber 48.

The flow accommodated by the dispensing nozzle 50 then has a pressure advantageously less than 5 bar, particularly between 2 bar and 4 bar, particularly equal to 3 bar.

Figure 8:
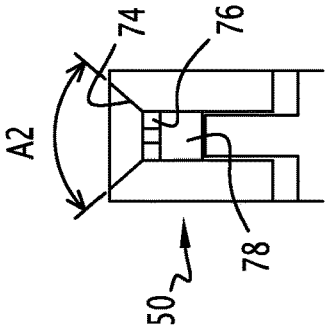
FIG. 8 is a schematic sectional view along a median axial plane of a nozzle for dispensing the mixture of water and cosmetic product mounted on the head in FIG. 1.

Preferably, the dispensing nozzle 50 is a hollow cone male nozzle. With reference to FIG. 8, it has a concave free surface 74, advantageously having a hollow conical shape, through which the orifice 76 thereof flows axially.

It advantageously has an inner mixing chamber 78 upstream from the orifice 36. It is for example made of metal.

The outlet angle A2 of the flow of droplets generated by the nozzle 32 is less than 100°, and is particularly between 70° and 90°.

An example of a dispensing nozzle 50 is marketed by ASJ SPRAY under the reference HCC015.

The droplets generated enable effective wetting of the keratin fibers and/or skin, and adequate lathering with the mixture of water and cosmetic product, with an application time in the region of some ten seconds, and a water consumption of less than 100 ml, particularly in the region of 50 ml.

The perforated member 52 consists of a grid inserted in the downstream chamber 48 to separate the upstream region 70 from the downstream region 72.

Advantageously, the perforated member 52 bears the receptacle 40 and the support base 54. It extends transversally relative to the central axis B-B'.

The function of the perforated member 52 is that of filtering the mixture prior to the passage thereof into the dispensing nozzle in order to retain any undissolved solid fractions.

The size of the openings of the perforated member 52 is between 0.3 mm and 3 mm, particularly 0.5 mm to 2 mm and preferably approximately 1 mm.

The base 54 is mounted under the perforated member 52 to protrude into the upstream region 70. It has a bottom partition 80 and a peripheral partition 82 having a complementary shape to the side wall 74 of the receptacle 40.

In this example, the bottom partition 80 is screwed under the perforated member 52. With reference to FIG. 1, the conveying assembly 16 comprises a pump 90, and a hose 91 containing an upstream conveying conduit 92, a three-way valve 94, a first downstream conveying conduit 96 and a second downstream conveying conduit 98

The pump 90 is suitable for drawing water in the container and for increasing the pressure of the water drawn, to transport said water in the upstream conveying conduit 92. It is borne by the platform 18.

The hose 91 surrounds and protects the conduits 92, 96, 98. It is for example formed from stapled metal tape. It is suitable for protruding away from the platform 18. The shower head 14 is mounted at the free end of the hose 91.

The upstream conveying conduit 92 connects the outlet of the pump 90 to an inlet of the three-way valve 94.

The first downstream conduit 96 connects a first outlet of the three-way valve 94 to the delivery module 20. It is connected downstream to the supply conduit 30 in the shower head 14.

The second downstream conduit 98 extends in parallel with the first downstream conduit 96. It connects a second outlet of the three-way valve 94 to the delivery module 22. It is connected downstream to the supply conduit 42 in the shower head 14.

The three-way valve 94 is herein borne by the hose 91. It is suitable for switching between a first configuration for supplying water to the delivery module 20, for delivering rinsing water, and a second configuration for supplying water to the dispensing module 22, for dispensing the mixture of water and cosmetic product.

It advantageously has an idle configuration, wherein neither the delivery module 20 nor the dispensing module 22 is supplied with water.

In the first supply configuration, the three-way valve 94 connects the upstream conveying conduit 92 solely to the first downstream conduit 96. In the second supply configuration, the three-way valve 94 connects the upstream conveying conduit 92 solely to the second downstream conduit 98.

The platform 18 comprises a frame 100 receiving the container 12 and the pump 90. It preferably comprises wheels 102 for moving the frame 100 in order to move the spraying device easily 10.

The hose 91 and the shower head 14 are suitable for being stored on or in the frame 100, when the device 10 is not used.

The operation of the spraying device 10 will now be described, for washing and/or treating a body surface of a user, for example for cleansing the user's hair.

Initially, the user takes hold of the shower head 14. He/she opens the removable cap 28 and inserts a receptacle 40 containing the cosmetic product. He/she fits said receptacle in the base 54.

Then, the user repositions the cap 28 on the support head 26, arranging the access wall 64 facing the inner nozzle 44. The inner nozzle 44 perforates the wall 64 and creates a downstream outlet 66 around the nozzle. It is partially inserted into the receptacle 40.

The user then switches the three-way valve 94 to set it to the idle configuration.

He/she then positions the dispensing nozzle 50 facing the body surface to be treated and activates the pump 90 or opens a supply valve.

He/she then switches the three-way valve 94 to the second configuration for supplying the dispensing module 22. Water is then pumped from the container 12 successively via the upstream conveying conduit 92, the three-way valve 94, the second downstream conveying conduit 98, and the supply conduit 42, to the inner nozzle 44.

With reference to FIG. 4, water is then sprayed in the receptacle 40 via the orifice 76 of the inner nozzle 44, in a first feed direction advantageously away from the supply conduit 42.

The mixing chamber 46 is thus created in the receptacle 40. Intense mixing of the cosmetic product with the water takes place, advantageously inducing dispersion of cosmetic product in water and adequate lathering, if applicable.

The mixture is extracted toward the upstream region 70 from the downstream chamber via the downstream outlet 66, in a second direction opposite the water feed direction in the mixing chamber 46.

The mixture is then rerouted in the first direction via the bottom of the head 26 and rises to the downstream region 72 around the receptacle 40, outside same (see FIG. 4).

The mixture then passes through the perforated member 52 and enters the downstream region 72.

It is then discharged from the shower head 14 via the dispensing nozzle 50. It forms droplets having a diameter less than 1 mm, and particularly comprised between 1 μm and 1000 μm with a discharge angle less than 100 and particularly between 70° and 90°.

The discharged mixture flow rate is kept low, advantageously less than 2 l per minute, and advantageously in the region of 0.8 l per minute.

The pressure of the mixture discharged by the dispensing nozzle 50 is advantageously less than 5 bar, and is particularly between 2 bar and 4 bar, particularly equal to 3 bar.

In view of the transfer into the mixing chamber 46 via the inner nozzle 44 and the dispersion taking place via the dispensing nozzle 50, a very small volume of mixture, less than 100 ml, and for example in the region of 50 ml for medium-length hair (lower neck), is sufficient to wet and disperse the mixture on the body surface, for example the hair, with adequate lathering.

The user then sets the valve 94 to the idle configuration thereof or deactivates the pump 50 or closes the valve. The user can then massage the hair or rub the skin as usual.

Then, if the user wishes to rinse the body surface, he/she switches the three-way valve 94 to set said valve to the first configuration. He/she activates the pump 90 to circulate water from the container 12 successively via the upstream conveying conduit 92, the first downstream conduit 96, and the supply conduit 30 to the delivery nozzle 32.

The rinsing water is then discharged from the shower head 14 via the delivery nozzle 32. It forms droplets having a diameter greater than 1 mm, and particularly comprised between 1 mm and 5 mm with a discharge angle less than 100 and particularly between 60° and 80°.

The discharged mixture flow rate is kept moderate, advantageously less than 3 l per minute, particularly between 1.0 l per minute and 2.0 l per minute, and advantageously in the region of 1.5 l per minute.

The pressure of the mixture discharged by the delivery nozzle 32 is advantageously less than 5 bar, and is particularly between 2 bar and 4 bar, particularly equal to 3 bar.

The drops formed are sufficiently large and heavy to speed up rinsing, while retaining moderate sizes to limit consumption.

Effective rinsing may then be obtained with a consumed water value of less than 2 l and in the region of 1.5 l for medium-length hair (base of neck).

The overall water consumption of the washing and treatment operation is thus particularly low, due to the complementary presence of nozzles 32, 50 having suitable dispersion characteristics for each phase. The nozzle 44 breaks up the water effectively during mixing with the cosmetic product and favors lather development.

This low consumption enables use of the device 10 in regions where access to running water is restricted or non-existent, in view of the compact and portable design of the device 10, with much more effective and convenient treatment/washing than with a bucket while maintaining consistent cosmetic qualities, for example in terms of lathering, treatment procedure and time.

If the shower head 14 is connected to a running water supply, the water consumption is reduced (compared to a conventional shower head).

The development of the dispersion and advantageously of the lather in the mixing chamber 46 also reduces the amount of cosmetic product required for the operation. This respects the body surface and facilitates rinsing further.

The tactile sensations on the body surface are further enhanced, particularly with respect to softness.

The use of removable receptacles 40 makes it possible to precisely control the dose of cosmetic product used.

In one alternative embodiment, the receptacle is permanently mounted in the shower head 14. It is for example formed directly by the base 54. When opening the cap 28, the user fills the receptacle 54 with cosmetic product from a container (for example when it is used up) or the user wishes to change cosmetic product.

Advantageously, the base 54 may be used either to receive a removable container 40, or to form a container receiving the product directly. If the base 54 is used to receive the product directly, it may be optionally closed by a closer.

In a further alternative embodiment, the three-way valve 94 is borne by the shower head 14.

In a further alternative embodiment, the hose 91 is connected directly to a water distribution network.

In a further alternative embodiment, the device 10 comprises a temperature probe suitable for measuring the temperature of the water introduced into the shower head 14 and a heating member for heating the water to a set-point temperature.

Illustrative examples of embodiments of the method according to the invention, using the device 10 will now be described.

The protocol applied is tested on medium-length straight hair to the base of the neck, with water at 38° C., having a hardness equal to 40° F. The following steps are applied:

- loading 6 g of DOP shampoo in capsule or on head or directly in the cap 28 of the shower head;
- supplying the dispensing module 22 with a water flow rate of 0.8 l/min and application for 10 seconds on the initially dry hair, producing partial wetting of the hair;
- stopping;
- massaging to start developing lather and distributing the product and water all over the hair, producing complete wetting of the hair and plentiful lather;
- supplying the dispensing module 22 with a water flow rate of 0.8 l/min for 5 seconds to finish applying all the shampoo;
- stopping;
- developing the lather and massaging;
- manually removing excess lather
- supplying the delivery module 20 with a flow rate chosen between 0.6 l/min and 1.6 l/min, until the product has been completely rinsed;
- stopping;
- between two applications, supplying fresh water to the dispensing module 22 to rinse the mixing chamber 46 and the downstream chamber 48.

| Exp | Shower head | Pressure (bar) | Rinsing flow rate (i/min) | Rinsing nozzle | Routine | Total quantity of water (i) | Lather |
|---|---|---|---|---|---|---|---|
| 1 | Wapple | 3 | 1.6 | 2.4 | Capsule | 2.50 | +++ |
| 2 | Wapple | 2.5 | 1.4 | 2.4 | capsule | 1.75 | +++ |
| 3 | Wapple | 1.5 | 1 | 2.4 | capsule | 2.25 | +++ |
| 4 | Wapple | 1.5 | 0.6 | 1.2 | capsule | 4 | +++ |
| 5 | Wapple | 2.5 | 0.9 | 1.2 | capsule | 3 | +++ |
| 6 | Wapple | 2.5 | 1.4 | 2.4 | In cover | 2.3 | +++ |
| 7 | Wapple | 2.5 | 1.4 | 2.4 | On head | 7 | +++ |
| 8 | Conventional/ network | 2.5 | 6.5 | / | On head | 11.5 | +++ |

-continued

| Exp | Shower head | Pressure (bar) | Rinsing flow rate (i/min) | Rinsing nozzle | Routine | Total quantity of water (i) | Lather |
|---|---|---|---|---|---|---|---|
| 9 | With flow limiter/ network | 2.5 | 3.6 | / | On head | 12.75 | +++ |
| 10 | Full | 3-4 | 1.1 | 1.2 | Capsule | 4.75 | +++ |
| 11 | Full | 3-4 | 1.6 | 2.4 | Capsule | 3.5 | +++ |
| 12 | Conventional on compressor | 3-4 | 2.2 | / | On head | >8 | +++ |

In the table above, the terms are defined as follows:

"Wapple": connection to running water network with water pressure control;

"Full": connection to a mobile standalone pump 90;

Dispensing nozzle 50: hollow cone, theoretical flow rate of 1 l/min to 3 bar, Rinsing nozzles 32: "1.2": Solid cone, theoretical flow rate of 1.2 l/min to 3 bar, "2.4": Solid cone, theoretical flow rate of 2.4 l/min to 3 bar.

A shower head with a flow limiter of approximately 50% (theoretically to 6 l/min) was used for experiment 9. Under the pressure conditions above, it indeed reduces the flow rate by approximately 50% (3.6 l/min instead of 6.5 l/min).

Examples 1 to 6 demonstrate that the quantity of water is markedly reduced relative to comparative example 8, with a gain in the quantity of lather obtained. The use of the shower head 14 with a conventional routine (product applied directly on the head, experiment 7) also reduces the quantity of water to a lesser degree than when a capsule or a dose is introduced into the shower head 14.

The use of a so-called "eco" shower head with a flow limiter penalizes the quantity of water required for shampooing, particularly for rinsing. (experiment 9)

The connection of the shower head to a pump 90 also reduces the quantity of water with a gain on lather (experiments 10 to 11).

The invention claimed is:

1. An element for dispensing a mixture of water and cosmetic product, comprising:

a hollow body, wherein the hollow body forms a shower head;

a receptacle for receiving a cosmetic product, housed in the hollow body;

a conduit for supplying water into the receptacle;

the hollow body defining a downstream chamber connected to the receptacle for receiving a mixture of water and cosmetic product from the receptacle, the element for dispensing comprising:

at least one nozzle for dispensing the mixture of water and cosmetic product from the element for dispensing;

the element for dispensing comprising an inner water dispensing nozzle, connected to the water supply conduit, the inner nozzle protruding into the receptacle to define a chamber for mixing water and the cosmetic product contained in the receptacle, the inner nozzle generates drops having an average size of less than 3 mm when the dispensing element is fed so that the mixture of water and cosmetic product is ejected by the dispensing nozzle with a flow rate of less than 1 liter per minute and a pressure less than 5 bars and more than 2 bars, and wherein the inner nozzle extends along an inner nozzle axis (B-B') into the mixing chamber, facing and axially shifted from a bottom wall of the receptacle.

2. The element according to claim 1, wherein the inner nozzle is suitable for generating a hollow cone type spray in the mixing chamber.

3. The element according to claim 2, wherein the inner nozzle extends along an inner nozzle axis (B-B') into the mixing chamber, facing and axially shifted from a bottom wall-of the receptacle, the length (L2) of the inner nozzle inserted into the mixing chamber along the inner nozzle axis (B-B') being between 25% and 50% of the length (L1) of the mixing chamber, measured along the inner nozzle axis (B-B') between a wall for accessing the mixing chamber, through which the inner nozzle is inserted, and the bottom wall.

4. The element according to claim 2, wherein the receptacle has an outlet for discharging the mixture of water and cosmetic product to the downstream chamber flowing in the direction opposite the direction for spraying water from the inner nozzle.

5. The element according to claim 1, wherein the length (L2) of the inner nozzle inserted into the mixing chamber along the inner nozzle axis (B-B') being between 25% and 50% of the length (L1) of the mixing chamber, measured along the inner nozzle axis (B-B') between a wall for accessing the mixing chamber, through which the inner nozzle is inserted, and the bottom wall.

6. The element to according to claim 5, wherein the receptacle has an outlet for discharging the mixture of water and cosmetic product to the downstream chamber flowing in the direction opposite the direction for spraying water from the inner nozzle.

7. The element according to claim 6, wherein the discharge outlet extends around the inner nozzle.

8. The element according to claim 1, wherein the receptacle has an outlet for discharging the mixture of water and cosmetic product to the downstream chamber flowing in the direction opposite the direction for spraying water from the inner nozzle.

9. The element according to claim 8, wherein a discharge outlet extends around the inner nozzle.

10. The element according to claim 1, wherein the downstream chamber comprises an upstream region for receiving the mixture of water and cosmetic product and a downstream region for discharging the mixture of water and cosmetic product flowing into the dispensing nozzle, the upstream region and the downstream region being situated on either side of the receptacle.

11. The element according to claim 1, wherein the downstream chamber comprises an upstream region for receiving the mixture of water and cosmetic product and a downstream region for discharging the water mixture, the element comprising a perforated member for treating the mixture of water and cosmetic product separating the upstream region from the downstream region.

12. The element according to claim 1, wherein the receptacle is formed by a removable capsule relative to the hollow body, the element comprising a base for locking the removable receptacle in the hollow body.

13. The element according to claim 1, wherein the receptacle is permanently mounted in the hollow body.

14. The element according to claim 1, wherein the shower head is intended to be connected to a running water network.

15. The element according to claim 1, comprising a nozzle for delivering a separate rinsing fluid from the dispensing nozzle.

16. A device for dispensing a mixture of water and cosmetic product, comprising:

a water container or a running water network;

an element according to claim 1; and a water conveyor from the water container or to the running water network to the element, the container, the element and the water conveyor being jointly movable on a platform.

17. The device according to claim 16, wherein the maximum volume of clean water to be contained in the water container is less than 50 liters.

18. A method for dispensing a mixture of water and cosmetic product, comprising the following steps:

providing a device according to claim 16;

supplying water from the container via the water conveyor to the water supply conduit;

injecting water into the mixing chamber via the inner nozzle;

mixing the water and cosmetic product in the mixing chamber;

dispensing the mixture of water and cosmetic product via the dispensing nozzle.

19. The method according to claim 18, comprising a prior step for loading a receptacle containing cosmetic product into the hollow body or a prior step for filling the receptacle in the hollow body with a cosmetic product.

20. A device for spraying fluid, comprising:

a water container or a running water network;

an element for spraying fluid comprising:

a hollow body;

a receptacle for receiving a cosmetic product, housed in the hollow body;

a conduit for supplying water into the receptacle;

the hollow body defining a downstream chamber connected to the receptacle for receiving a mixture of water and cosmetic product from the receptacle, the element for spraying comprising:

at least one nozzle for spraying fluid from the element for spraying;

the element for spraying comprising an inner water dispensing nozzle, connected to the water supply conduit, the inner nozzle protruding into the receptacle to define a chamber for mixing water and the cosmetic product contained in the receptacle, the inner nozzle generates drops having an average size of less than 3 mm when the dispensing element is fed so that the mixture of water and cosmetic product is ejected by the dispensing nozzle with a flow rate of less than 1 liter per minute and a pressure less than 5 bars and more than 2 bars; and a water conveyor from the water container or to the running water network to the element, the container, the element and the water conveyor being advantageously jointly movable on a platform.

* * * * *